US011145973B2

(12) United States Patent
Pan et al.

(10) Patent No.: US 11,145,973 B2
(45) Date of Patent: Oct. 12, 2021

(54) PLANAR END-FIRE PATTERN RECONFIGURABLE ANTENNA

(71) Applicant: SOUTH CHINA UNIVERSITY OF TECHNOLOGY, Guangdong (CN)

(72) Inventors: Yongmei Pan, Guangdong (CN); Yun Ouyang, Guangdong (CN); Shaoyong Zheng, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 17/260,561

(22) PCT Filed: Feb. 25, 2019

(86) PCT No.: PCT/CN2019/076009
§ 371 (c)(1),
(2) Date: Jan. 15, 2021

(87) PCT Pub. No.: WO2020/015359
PCT Pub. Date: Jan. 23, 2020

(65) Prior Publication Data

US 2021/0273328 A1 Sep. 2, 2021

(30) Foreign Application Priority Data

Jul. 18, 2018 (CN) ..... 201810791251.4

(51) Int. Cl.
*H01Q 9/28* (2006.01)
*H01Q 3/24* (2006.01)
*H01Q 1/48* (2006.01)

(52) U.S. Cl.
CPC ..... *H01Q 3/242* (2013.01); *H01Q 1/48* (2013.01); *H01Q 9/285* (2013.01)

(58) Field of Classification Search
CPC ..... H01Q 3/24; H01Q 9/04; H01Q 9/285; H01Q 1/38–1/48
See application file for complete search history.

(56) References Cited

U.S. PATENT DOCUMENTS 8,648,770 B2 * 2/2014 Schneider ..... H01Q 9/0421 343/893
9,590,314 B2 * 3/2017 Celik ..... H01Q 9/0464
10,680,338 B2 * 6/2020 Leung ..... H01Q 9/0492

FOREIGN PATENT DOCUMENTS

CN 105206911 12/2015
CN 106450760 2/2017
(Continued)

OTHER PUBLICATIONS

"International Search Report (Form PCT/ISA/210) of PCT/CN2019/076009", dated May 29, 2019, with English translation thereof, pp. 1-4.

*Primary Examiner* — Hasan Islam
(74) *Attorney, Agent, or Firm* — JCIPRNET

(57) ABSTRACT

The invention discloses a planar end-fire pattern reconfigurable antenna, including a dielectric substrate, a radiation patch, a ground plane, a switch and bias circuit, and a coaxial cable, wherein the dielectric substrate includes a first surface and a second surface in opposite, the radiation patch is attached to the first surface of the dielectric substrate, the ground plane is attached to the second surface of the dielectric substrate, the switch and bias circuit is arranged in a slot of the ground plane, the coaxial cable includes an outer conductor and an inner conductor, the outer conductor is connected to the ground plane, the inner conductor penetrates through the dielectric substrate and is connected to the radiation patch, and the coaxial cable is arranged at a geometric center of the planar end-fire pattern reconfigurable antenna.

9 Claims, 5 Drawing Sheets

(56) References Cited

FOREIGN PATENT DOCUMENTS

| | | |
|---|---|---|
| CN | 206040973 | 3/2017 |
| CN | 109066073 | 12/2018 |
| WO | 2013126124 | 8/2013 |

* cited by examiner

PLANAR END-FIRE PATTERN RECONFIGURABLE ANTENNA

CROSS-REFERENCE TO RELATED APPLICATION

This application is a 371 application of the International PCT application serial no. PCT/CN2019/076009, filed on Feb. 25, 2019, which claims the priority benefits of China application no. 201810791251.4, filed on Jul. 18, 2018. The entirety of each of the above-mentioned patent applications is hereby incorporated by reference herein and made a part of this specification.

BACKGROUND

Technical Field

The present invention relates to the field of wireless mobile communication, and more particularly, to a planar end-fire pattern reconfigurable antenna.

Description of Related Art

An end-fire antenna is an antenna with a maximum radiation direction parallel to a plane of radiator, and common end-fire antennas include a Yagi antenna, a spiral antenna, and the like.

The end-fire antenna has wide application requirements in both military and civil fields, especially in some scenes with a limited space size, such as handheld devices, cordless phones, vehicle-mounted and aircraft systems, and the like, which often need to employ a low-profile end-fire antenna. On the other hand, a pattern reconfigurable antenna has a characteristic of dynamically controlling beam scanning, which can effectively reduce multipath fading and electromagnetic interference, and improve a channel capacity. Therefore, the low-profile, end-fire and pattern reconfigurable antenna has been widely concerned in recent years. However, radiation patterns of the low-profile end-fire antenna proposed at this stage are mostly fixed in one direction, so that flexible control cannot be implemented. Meanwhile, it is very difficult to implement a reconfigurable pattern due to an asymmetry of a structure. However, a large reflector or a multi-stage director structure are used in most of existing reconfigurable antennas, so that the antennas have a larger volume, a high profile, and a high design complexity, which are not beneficial for integrated application, and cannot be matched with development trends of integration and miniaturization of a mobile terminal device.

SUMMARY

In view of this, in order to solve the above problems in the prior art, the present invention provides a planar end-fire pattern reconfigurable antenna, which solves problems that an existing low-profile end-fire antenna cannot implement flexible beam control, and an existing pattern reconfigurable antenna has a large volume and a high profile.

In order to achieve the above objective, the technical solutions of the present invention are as follows.

A planar end-fire pattern reconfigurable antenna includes a dielectric substrate, a radiation patch, a ground plane, a switch and bias circuit, and a coaxial cable. The dielectric substrate includes a first surface and a second surface in opposite. The radiation patch is attached to the first surface of the dielectric substrate. The ground plane is attached to the second surface of the dielectric substrate. The switch and bias circuit is arranged in a slot of the ground plane. The coaxial cable includes an outer conductor and an inner conductor. The outer conductor is connected to the ground plane, and the inner conductor penetrates through the dielectric substrate and is connected to the radiation patch. The coaxial cable is arranged at a geometric center of the planar end-fire pattern reconfigurable antenna, and used for exciting the radiation patch and the ground plane. The radiation patch is used for generating electromagnetic radiation like a magnetic dipole perpendicular to a plane of the radiation patch. The ground plane is used for generating electromagnetic radiation like an electric dipole parallel to a plane of the ground plane. The switch and bias circuit generates a reconfigurable end-fire radiation pattern by controlling on-off state combination of a switch.

Further, the magnetic dipole and the electric dipole have complementary radiation patterns, and the electromagnetic radiation of the magnetic dipole and the electromagnetic radiation of the electric dipole have a superposition effect in a first direction parallel to a plane of the dielectric substrate, and generate an offset effect in a second direction opposite to the first direction, thus forming the end-fire radiation pattern.

Further, the dielectric substrate has a circular structure.

Further, the dielectric substrate has the circular structure; and the radiation patch has an Alford loop structure, and includes outer ring branches and connecting arms, the outer ring branches are connected to the connecting arms. A gap is formed between the outer ring branches, and a number of the outer ring branches is the same as that of the connecting arms, which is 3 to 8.

Further, a shape of the outer ring branch and a shape of the connecting arm are arc, rectangular, or stepped.

Further, a line width of the outer ring branch is the same as or different from a line width of the connecting arm, and used for adjusting impedance matching of the antenna, and the line widths range from 0.5 mm to 6 mm; and a length of the outer ring branch and a length of the connecting arm are used for controlling a resonant frequency of the antenna, and a sum of the lengths of all the outer ring branches is $1\lambda_g$ to $2\lambda_g$.

Further, a diameter of the ground plane is $0.4\lambda_g$ to $0.6\lambda_g$.

Further, the ground plane includes a radial slot, a length of the radial slot is smaller than a radius of the ground plane, a shape of the radial slot is rectangular, fanned, or trapezoidal, and a number of the radial slots is the same as or different from the number of the outer ring branches and the number of the connecting arms, which is 3 to 8.

Further, the radial slot is internally provided with the switch and bias circuit, the switch and bias circuit is arranged at a periphery of the radial slot, and includes a PIN diode, an inductor, a capacitor, and a direct current connecting wire, and a number of the switch and bias circuits is the same as that of the radial slots.

Further, a beam scanning range of the planar end-fire pattern reconfigurable antenna is a whole 360° azimuth plane.

Compared with the prior art, the planar end-fire pattern reconfigurable antenna of the present invention has the following effects.

1. Low-profile characteristic: a single-layer board structure is used in the antenna, with a low profile, and a profile height is only $0.024\lambda_0$, thus being easy to process and integrate.

2. Good end-fire radiation characteristic: a front-to-back ratio is 25.5 dB, and a peak gain is 4.1 dBi.

3. The reconfigurability of the pattern is implemented by using a PIN diode switch, and the beam scanning range may cover the whole 360° azimuth plane.

4. The coaxial cable is used for central feeding, the antenna has a simple structure, and radiation efficiency is as high as 83%.

DESCRIPTION OF THE EMBODIMENTS

Figure 1:
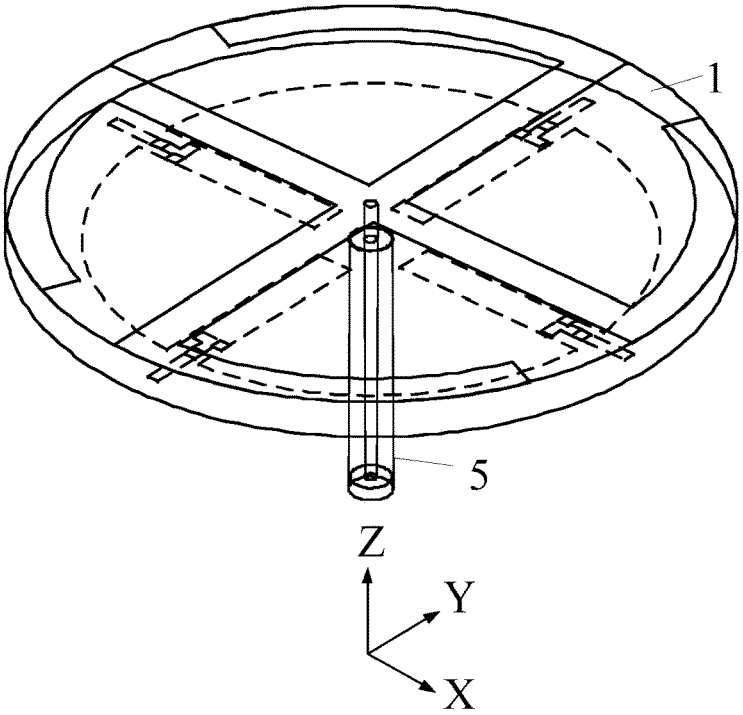
FIG. 1 is a schematic stereoscopic diagram of an embodiment of a planar end-fire pattern reconfigurable antenna according to the present invention.

The specific implementation of the present invention is further described hereinafter with reference to the accompanying drawings and the specific embodiments. It shall be pointed out that the described embodiments are only some but not all of the embodiments of the present invention, and based on the embodiments of the present invention, other embodiments obtained by those of ordinary skills in the art without going through any creative work all belong to the scope of protection of the present invention.

As shown in FIG. 1 to FIG. 4, in the embodiment, a F4BMX with a thickness of 3 mm, a relative dielectric constant of 2.2, and a loss tangent of 0.0007 is used as a dielectric substrate 1, which includes a first surface and a second surface in opposite. A radiation patch 2 is attached to the first surface of the dielectric substrate 1. A ground plane 3 is attached to the second surface of the dielectric substrate 1. A switch and bias circuit 4 is arranged in a slot of the ground plane 3. A coaxial cable 5 penetrates through a geometric center of the antenna. An outer conductor of the coaxial cable is connected to the ground plane 3, and an inner conductor of the coaxial cable penetrates through the dielectric substrate 1 and is connected to the radiation patch 2. When the radiation patch 2 and the ground plane 3 are excited by an electrical signal passing through the coaxial cable 5, combined arrangement of the radiation patch 2 and the ground plane 3 generates electromagnetic radiation in an end-fire direction. A reconfigurable end-fire radiation pattern is generated by controlling on-off state combination of multiple switches (6, 7, 8, and 9).

Figure 2:
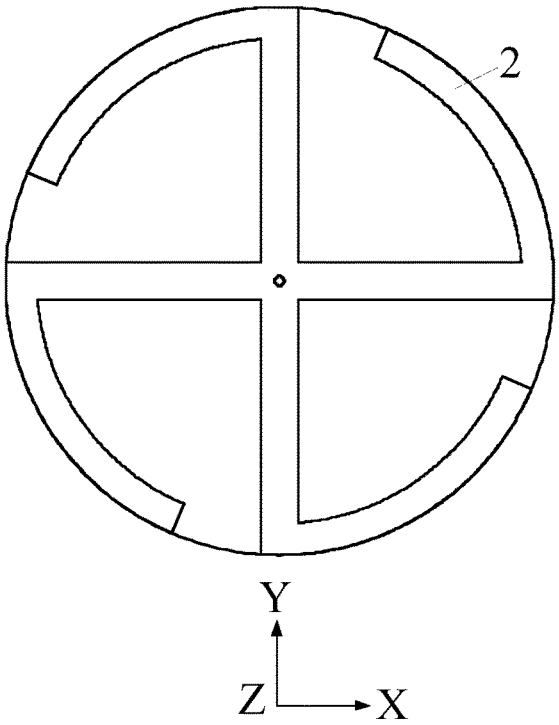
FIG. 2 is a top view of a radiation patch in the embodiment of the planar end-fire pattern reconfigurable antenna according to the present invention.

As shown in FIG. 2, the radiation patch 2 has an Alford loop structure, and includes multiple outer ring branches and multiple connecting arms, and a gap is formed between each outer ring branch. A number of the outer ring branches and a number of the connecting arms have a large degree of freedom in selection, which may be 3 to 8. In the embodiment, four outer ring branches and four connecting arms are used. A shape of the outer ring branch and a shape of the connecting arm also have a large degree of freedom in selection, which may be arc, rectangular, stepped, or equivalently deformed. In the embodiment, a structure of an arc outer ring branch and a rectangular connecting arm is used. A line width of the outer ring branch is the same as or different from a line width of the connecting arm, and may be used for adjusting impedance matching of the antenna, and the line widths range from 0.5 mm to 6 mm. In the embodiment, the line width of the outer ring branch is 3 mm, and the line width of the connecting arm is 3.5 mm. A length of the outer ring branch and a length of the connecting arm are used for controlling a resonant frequency of the antenna, and a sum of the lengths of all the outer ring branches is $1\lambda_g$ to $2\lambda_g$. In the embodiment, the sum of the lengths of all the outer ring branches is $1.5\lambda_g$.

Figure 3:
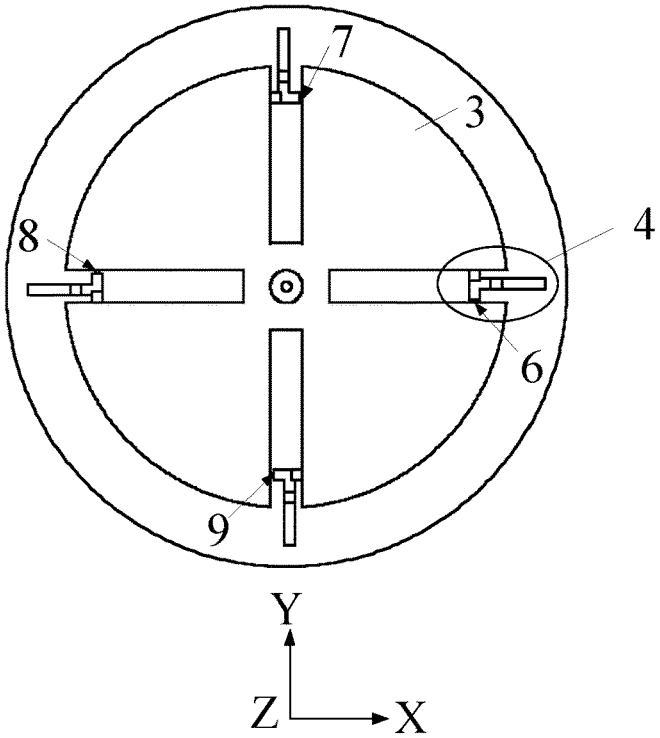
FIG. 3 is a schematic diagram of a ground plane in the embodiment of the planar end-fire pattern reconfigurable antenna according to the present invention.
Figure 4:
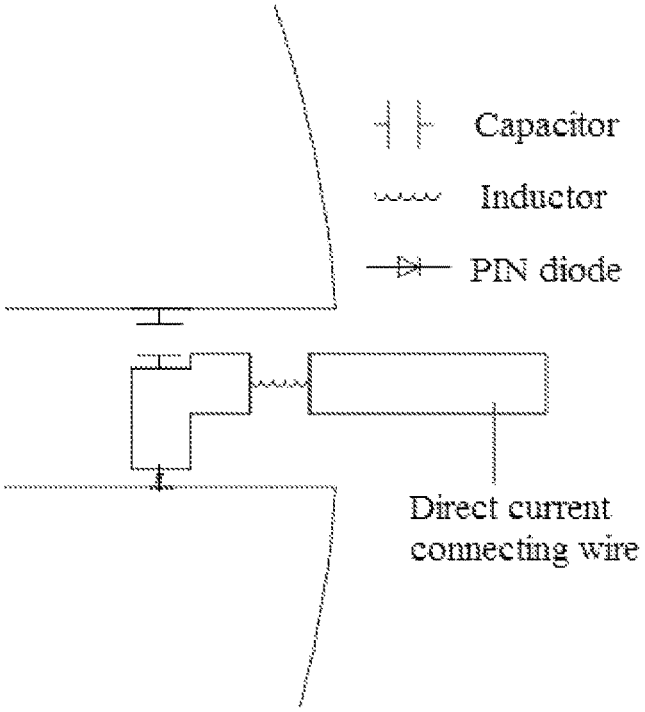
FIG. 4 is a schematic diagram of a switch and bias circuit in the embodiment of the planar end-fire pattern reconfigurable antenna according to the present invention.

As shown in FIG. 3 and FIG. 4, a diameter of the ground plane 3 is $0.4\lambda_g$ to $0.6\lambda_g$. In the embodiment, the diameter of the ground plane 3 is $0.5\lambda_g$. The ground plane 3 includes a radial slot, and a length of the radial slot is smaller than a radius of the ground plane 3. A shape of the radial slot has a large degree of freedom in selection, and may be rectangular, fanned, trapezoidal, and other deformed structures. A rectangular structure is used in the embodiment. The radial slot is internally provided with the switch and bias circuit 4, the switch and bias circuit 4 includes a PIN diode, an inductor, a capacitor, and a direct current connecting wire. A number of the radial slots is the same as that of the switches, which means that each radial slot is internally provided with one switch. The number has a large degree of freedom in selection, which may be 3 to 8. The number determines a number of reconfigurable states, which means that n switches correspond to n reconfigurable states. In the embodiment, a structure of four radial slots and four switches is used to implement four reconfigurable states. An $i^{th}$ state of the n reconfigurable states is defined as a case that a $j^{th}$ switch of the n switches is turned off and remaining n−1 switches are turned on. A maximum radiation direction of the $i^{th}$ reconfigurable state is defined as a direction pointed by the radial slot where the $j^{th}$ switch is located. In the embodiment, a $I^{th}$ state is defined as a case that the switch 6 is turned off and remaining three switches are turned on. A maximum radiation direction of the $I^{th}$ state is defined as a +x direction pointed by the radial slot where the switch 6 is located. The reconfigurability of the pattern may be implemented by controlling on-off state combination of multiple switches. A beam scanning range of the planar end-fire pattern reconfigurable antenna is a whole 360° azimuth plane. The switch is preferably located at a periphery of the radial slot. The diameter of the ground plane, the length of the radial slot, and the position of the switch determine the front-back ratio of the end-fire radiation pattern.

On-off combination manners of switches in four working states of the antenna described in the embodiment are shown in Table 1.

TABLE 1

| State | Switch 6 | Switch 7 | Switch 8 | Switch 9 |
|---|---|---|---|---|
| I | Turn off | Turn on | Turn on | Turn on |
| II | Turn on | Turn off | Turn on | Turn on |
| III | Turn on | Turn on | Turn off | Turn on |
| IV | Turn on | Turn on | Turn on | Turn off |

According to the above parameters, a reflection coefficient, a front-to-back ratio, a gain, an efficiency, a radiation pattern, and other characteristic parameters of the planar end-fire pattern reconfigurable antenna are simulated and analyzed by using high-frequency electromagnetic simulation software HFSS, and the characteristic parameters are tested and verified by using a network analyzer of Agilent Technology Company and a Satimo StarLab system. Analysis results are as follows.

Since the embodiment has a structural symmetry, curves of the reflection coefficient, the front-to-back ratio, and the gain in the states should be consistent in theory, which is also verified by simulation results. Therefore, only one simulation result curve is given in FIG. 5 to FIG. 8. Four testing result curves are given to reflect actual performances in the four states.

Figure 5:
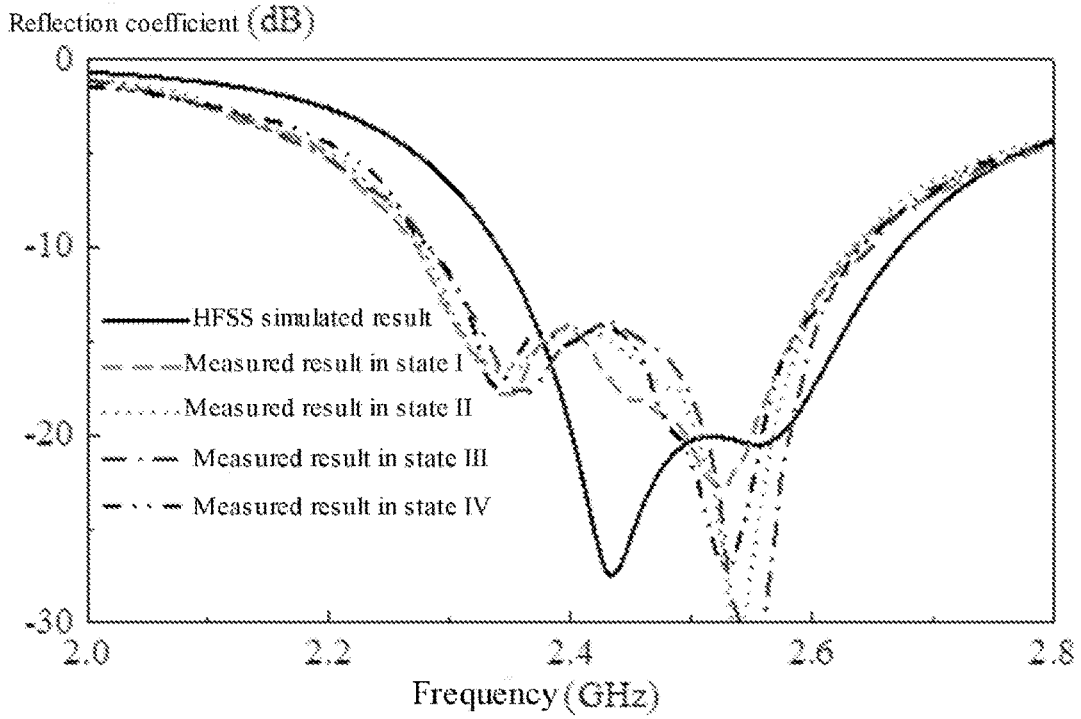
FIG. 5 is a curve graph of a simulated and measured reflection coefficient in the embodiment of the planar end-fire pattern reconfigurable antenna according to the present invention.

As shown in FIG. 5, the curves of the reflection coefficients in simulation and testing in the embodiment of the present invention are quite consistent, and testing results in the states are also very close. An impedance bandwidth in testing is 15% (2.27 GHz to 2.64 GHz). The testing result is very close to a simulation result of 13.2% (2.34 GHz to 2.67 GHz). Existing alight frequency offset is mainly caused by a specific machining and experimental error. Certainly, imperfect simulation models of the inductor, the capacitor, the PIN diode, and other lumped components are also a part of reasons for the frequency offset.

Figure 6:
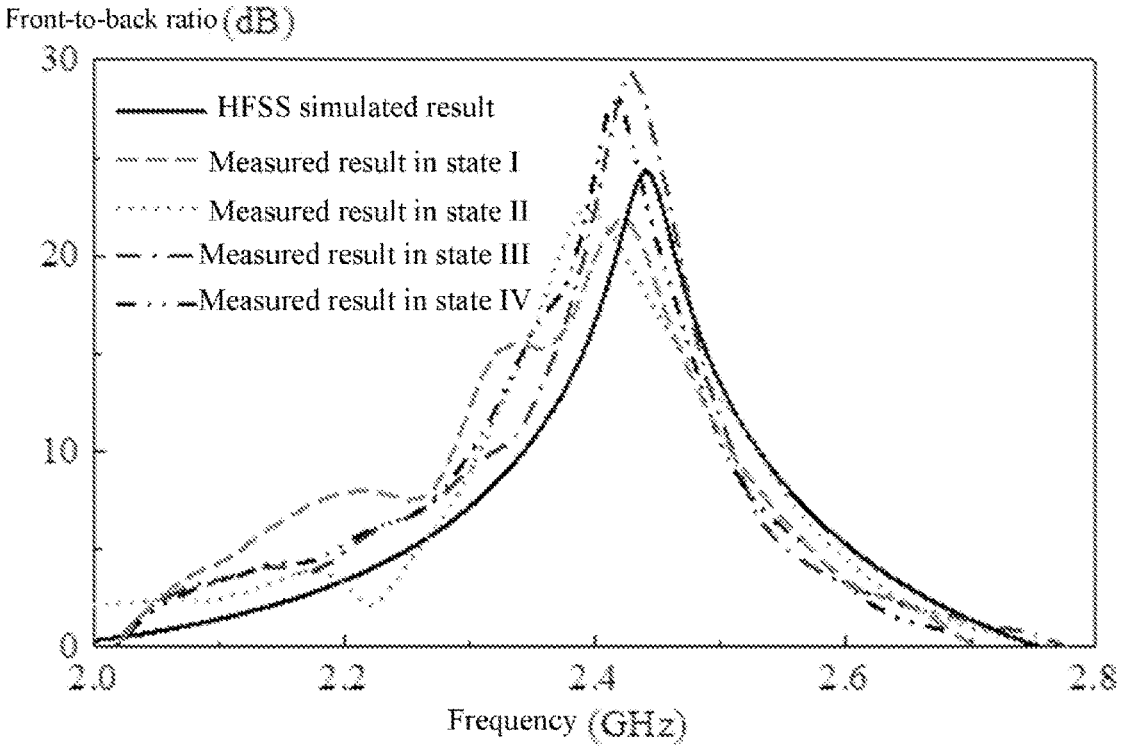
FIG. 6 is a curve graph of a simulated and measured front-to-back ratio in the embodiment of the planar end-fire pattern reconfigurable antenna according to the present invention.

As shown in FIG. 6, the curves of the front-to-back ratios in simulation and testing in the states in the embodiment of the present invention are also quite consistent, a maximum front-to-back ratio in simulation is 24.3 dB, maximum front-to-back ratios in testing in different states are 22 dB, 22.4 dB, 29.4 dB and 28.2 dB respectively.

Figure 7:
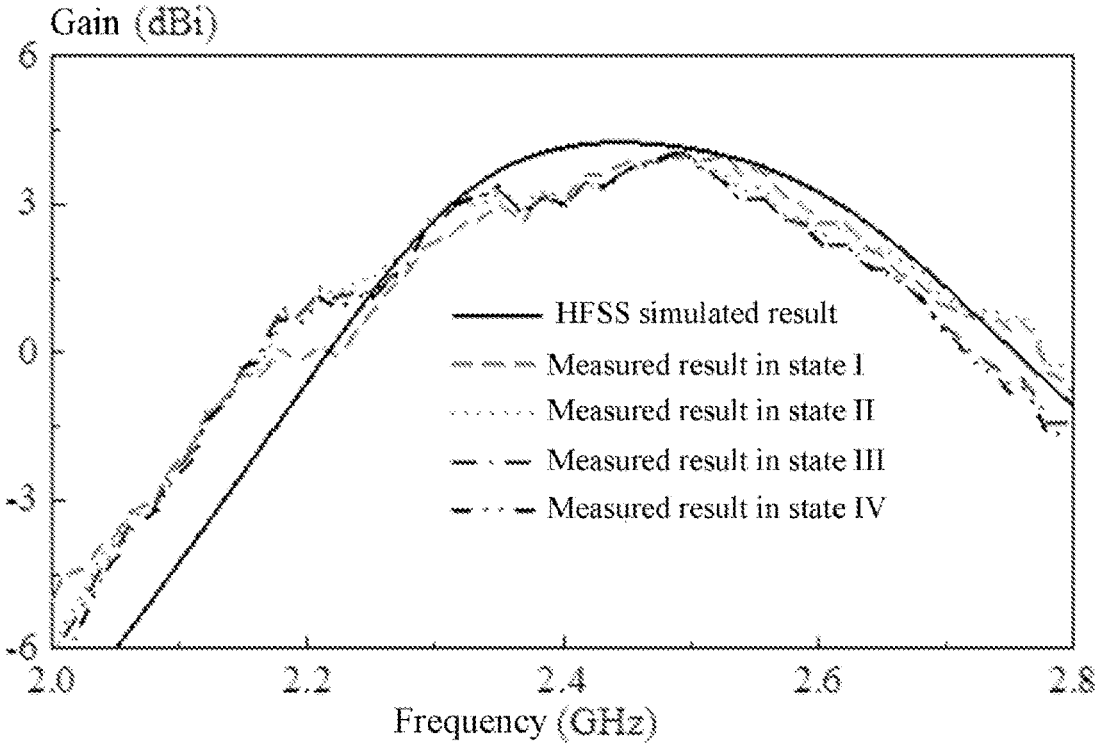
FIG. 7 is a curve graph of a simulated and measured gain in the embodiment of the planar end-fire pattern reconfigurable antenna according to the present invention.

As shown in FIG. 7, the curves of the gains in simulation and testing in the embodiment of the present invention have a same trend, wherein an in-band average gain in simulation is 4.19 dBi, while testing results in different states fluctuate slightly, and in-band average gains in testing in different states are 3.23 dBi, 3.31 dBi, 3.42 dBi, and 3.36 dBi respectively.

Figure 8:
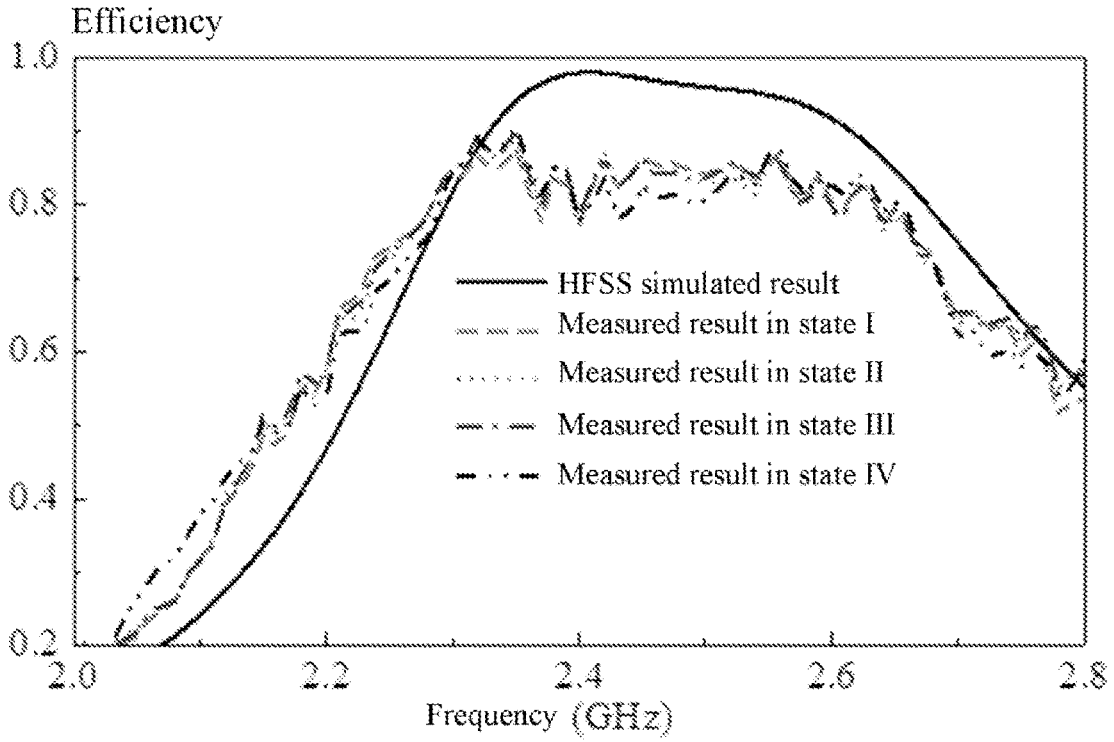
FIG. 8 is a curve graph of a simulated and measured efficiency in the embodiment of the planar end-fire pattern reconfigurable antenna according to the present invention.

As shown in FIG. 8, efficiencies in testing in the states in the embodiment of the present invention are basically the same, and average efficiencies in testing in the states in a passband are all 83%, while the efficiency in simulation is 97%. The gain and the efficiency in testing are both slightly lower than simulation results, which is mainly caused by losses of the lumped element and the direct current connecting wire in the bias circuit.

Figure 9:
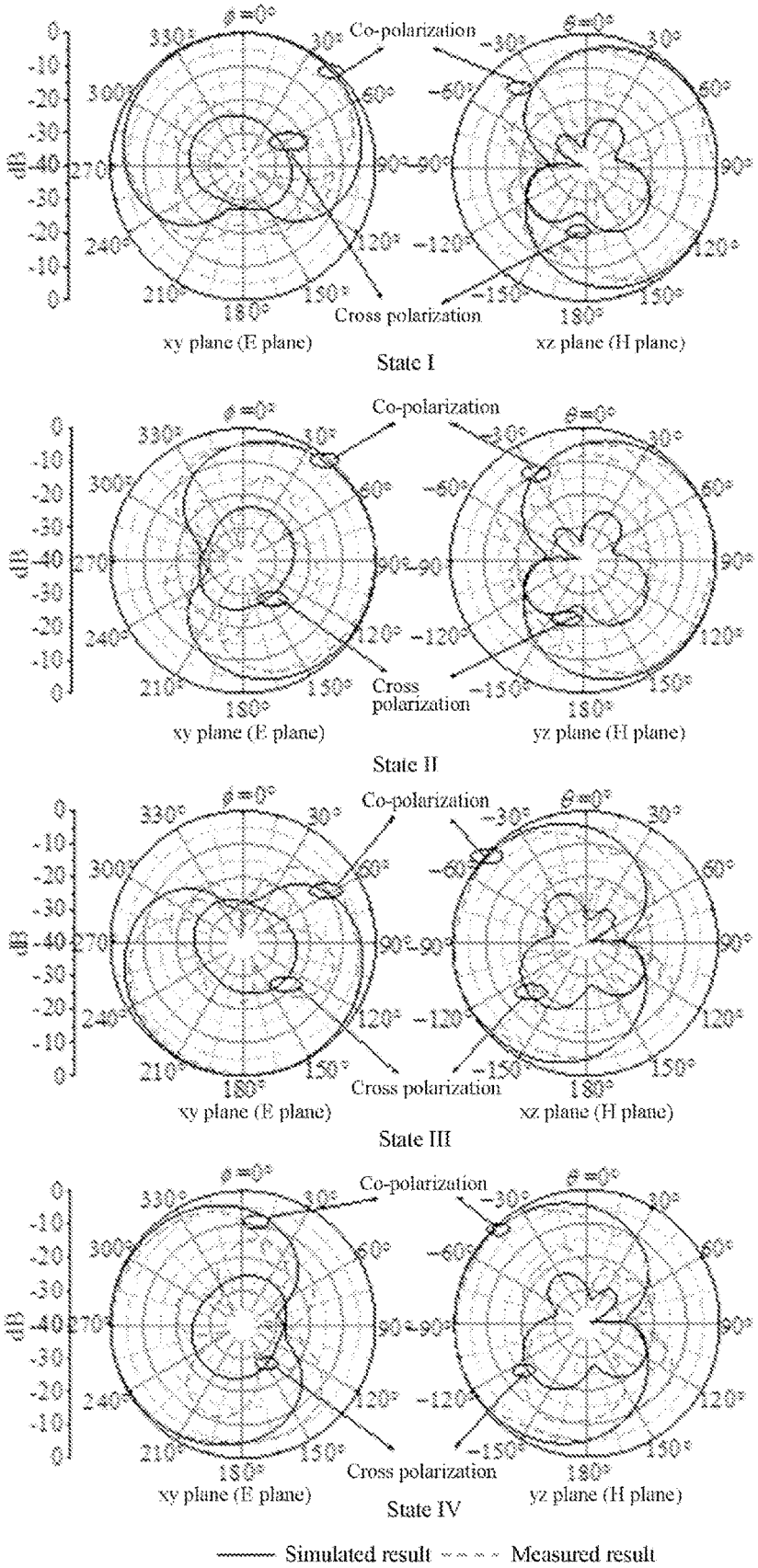
FIG. 9 is a normalized pattern of working states I, II, III and IV at 2.44 GHz in the embodiment of the planar end-fire pattern reconfigurable antenna according to the present invention.

As shown in FIG. 9, the simulation and testing results of the radiation pattern in the states in the embodiment are given. A pattern of the azimuth plane rotates with a change of the state, and the patterns of the azimuth plane in different states point to $\phi=0°$, $\phi=90°$, $\phi=180°$, and $\phi=270°$ respectively. However, a pattern of a vertical plane remains basically unchanged, always pointing to a horizontal plane, which means that an end-fire radiation characteristic is kept. Half-power beam widths of a pattern of an E-plane in testing in the states are all 135°, which shows that the whole 360 azimuth plane may be covered by beams in four states in the embodiment.

To sum up, the planar end-fire pattern reconfigurable antenna of the present invention has the advantages of compact size and simple structure while having excellent circuit characteristics and radiation characteristics, and reduces a complexity and a cost of a radio frequency antenna module.

What is claimed is:

1. A planar end-fire pattern reconfigurable antenna, comprising:

a dielectric substrate, a radiation patch, a ground plane, a switch and bias circuit, and a coaxial cable, wherein the dielectric substrate comprises a first surface and a second surface in opposite, the radiation patch is attached to the first surface of the dielectric substrate, the ground plane comprises a radial slot, the ground plane is attached to the second surface of the dielectric substrate, the switch and bias circuit is arranged in the radial slot of the ground plane, the coaxial cable comprises an outer conductor and an inner conductor, the outer conductor is connected to the ground plane, and the inner conductor penetrates through the dielectric substrate and is connected to the radiation patch;

wherein the coaxial cable is arranged at a geometric center of the planar end-fire pattern reconfigurable antenna, and used for exciting the radiation patch and the ground plane, the radiation patch is used for generating electromagnetic radiation from a magnetic dipole perpendicular to a plane of the radiation patch, the ground plane is used for generating electromagnetic radiation from an electric dipole parallel to a plane of the ground plane, and the switch and bias circuit generates a reconfigurable end-fire radiation pattern by controlling on-off state combination of a switch of the switch and bias circuit;

wherein the radiation patch has an Alford loop structure, and comprises outer ring branches and connecting arms, the outer ring branches are connected to the connecting arms, a gap is formed between the outer ring branches, and a number of the outer ring branches is the same as that of the connecting arms; and wherein the radial slot is internally provided with the switch and bias circuit, the switch and bias circuit is arranged near an edge of the ground plane, and comprises a PIN diode, an inductor, a capacitor, and a direct current connecting wire, and a number of the switch and bias circuit is the same as that of the radial slot.

2. The planar end-fire pattern reconfigurable antenna according to claim 1, wherein the magnetic dipole and the electric dipole have complementary radiation patterns, and the electromagnetic radiation of the magnetic dipole and the electromagnetic radiation of the electric dipole have a superposition effect in a first direction parallel to a plane of the dielectric substrate, and generate an offset effect in a second direction opposite to the first direction, thus forming the end-fire radiation pattern.

3. The planar end-fire pattern reconfigurable antenna according to claim 1, wherein the dielectric substrate has a circular structure.

4. The planar end-fire pattern reconfigurable antenna according to claim 1, wherein a number of the outer ring branches is the same as that of the connecting arms, which is 3 to 8.

5. The planar end-fire pattern reconfigurable antenna according to claim 4, wherein a shape of each of the outer ring branches and a shape of each of the connecting arms are arc, rectangular, or stepped.

6. The planar end-fire pattern reconfigurable antenna according to claim 1, wherein a line width of each of the outer ring branches is the same as or different from a line width of each of the connecting arms, and used for adjusting impedance matching of the antenna, and the line widths range from 0.5 mm to 6 mm; and a length of each of the outer ring branches and a length of each of the connecting aims are used for controlling a resonant frequency of the antenna, and a sum of the lengths of all the outer ring branches is $1\lambda_g$ to $2\lambda_g$.

7. The planar end-fire pattern reconfigurable antenna according to claim 1, wherein a diameter of the ground plane is $0.4\lambda_g$ to $0.6\lambda_g$.

8. The planar end-fire pattern reconfigurable antenna according to claim 1, wherein a length of the radial slot is smaller than a radius of the ground plane, a shape of the radial slot is rectangular, fanned, or trapezoidal, and a number of the radial slot is the same as or different from the number of the outer ring branches and the number of the connecting arms, which is 3 to 8.

9. The planar end-fire pattern reconfigurable antenna according to claim 1, wherein a beam scanning range of the planar end-fire pattern reconfigurable antenna is a whole 360° azimuth plane.

* * * * *